US009360783B2

(12) United States Patent
Mine et al.

(10) Patent No.: US 9,360,783 B2
(45) Date of Patent: Jun. 7, 2016

(54) TONER FOR ELECTROSTATIC IMAGE DEVELOPMENT

(71) Applicant: Konica Minolta, Inc., Tokyo (JP)

(72) Inventors: Tomoko Mine, Tokyo (JP); Anju Hori, Tokyo (JP); Ken Ohmura, Tokyo (JP); Mikio Kouyama, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 12 days.

(21) Appl. No.: 14/305,538

(22) Filed: Jun. 16, 2014

(65) Prior Publication Data

US 2014/0377700 A1 Dec. 25, 2014

(30) Foreign Application Priority Data

Jun. 21, 2013 (JP) ..... 2013-130135

(51) Int. Cl.
*G03G 9/087* (2006.01)

(52) U.S. Cl.
CPC ..... *G03G 9/08755* (2013.01); *G03G 9/08782* (2013.01); *G03G 9/08795* (2013.01); *G03G 9/08797* (2013.01)

(58) Field of Classification Search
CPC ..... G03G 9/08755; G03G 9/08795; G03G 9/08797
USPC ..... 430/109.4
See application file for complete search history.

(56) References Cited

U.S. PATENT DOCUMENTS

| | | | | |
|---|---|---|---|---|
| 8,022,170 | B2 * | 9/2011 | Hoffmann | C08G 69/34 525/420 |
| 2011/0217646 | A1 * | 9/2011 | Shirai | G03G 9/087 430/109.4 |
| 2012/0276477 | A1 * | 11/2012 | Wosnick | G03G 9/08755 430/109.4 |

FOREIGN PATENT DOCUMENTS

| | | | |
|---|---|---|---|
| JP | 2007-114398 | A | 5/2007 |
| JP | 2012-063559 | A | 3/2012 |

OTHER PUBLICATIONS

Grant, R. et al., ed., Grant & Hackh's Chemical Dictionary, fifth edition, McGraw-Hill Book Company, NY (1987), p. 522.*
Pripol Datasheet—Polymerised fatty acids, Croda Lubriants, copyright 2008, www.crodalubricants.com/download.aspx?s=133&m=doc&id=341 (downloaded Aug. 23, 2015).*
National Center for Biotechnology Information. PubChem Compound Database; CID=22833342, created Dec. 5, 2007, modified Aug. 15, 2015. https://pubchem.ncbi.nlm.nih.gov/compound/22833342(accessed Aug. 23, 2015), pp. 1-7.*

* cited by examiner

*Primary Examiner* — Janis L Dote
(74) *Attorney, Agent, or Firm* — Lucas & Mercanti, LLP

(57) ABSTRACT

The toner includes: a second amorphous polyester resin including a structural unit represented by any of the following general formulas (1) to (3); and a first amorphous polyester resin including no structural units represented by the general formulas (1) to (3). $R^1$, $R^2$, $R^5$, $R^9$ and $R^{10}$ are each independently an alkyl group having 4 to 15 carbon atoms or an alkenyl group having 4 to 15 carbon atoms, $R^3$, $R^4$, $R^7$, $R^8$ and $R^{11}$ are each independently an alkylene group having 4 to 14 carbon atoms or an alkenylene group having 4 to 14 carbon atoms, $R^6$ is a saturated or unsaturated divalent aliphatic hydrocarbon group having 4 to 15 carbon atoms, and $R^{12}$ is a saturated or unsaturated trivalent aliphatic hydrocarbon group having 4 to 14 carbon atoms, and X is an aromatic ring, a carbocyclic ring or a group represented by the following formula (A).

General Formula (1)

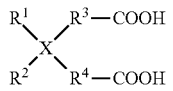

General Formula (2)

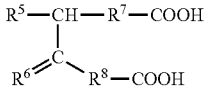

General Formula (3)

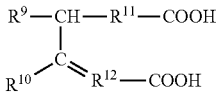

Formula (A)

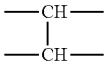

13 Claims, No Drawings

TONER FOR ELECTROSTATIC IMAGE DEVELOPMENT

CROSS REFERENCE TO RELATED APPLICATION

This Application claims the priority of Japanese Patent Application No. 2013-130135 filed on Jun. 21, 2013, which is incorporated by reference herein.

TECHNICAL FIELD

The present invention relates to a toner for electrostatic image development that is used in image formation of an electrophotographic system.

BACKGROUND ART

To achieve energy saving, speedup, and space saving of image forming apparatuses, there is a need for a toner for electrostatic image development (hereinafter may be referred to simply as a "toner") that has better low-temperature fixability. One known toner is designed such that a crystalline polyester resin having sharp melting properties is introduced into the toner to lower the glass transition point and melt viscosity of a binder resin.

In such a toner, the balance of affinity between an amorphous resin introduced as a main resin such as an amorphous polyester resin and crystalline materials such as the crystalline polyester resin and a wax is controlled to suppress bleeding of the crystalline materials to the surface of toner particles, and sufficient post-fixing separability must thereby be ensured.

For example, Patent Literature 1 discloses a toner in which dodecenyl succinic acid is used as a constituent amorphous polyester resin. In this toner, the affinity between the amorphous polyester resin and the crystalline materials is improved through a side chain of dodecenyl succinic acid. Patent Literature 2, for example, discloses a toner containing a dispersant composed of a crystalline material.

However, even with these toners, bleeding of the crystalline materials cannot be suppressed sufficiently, and both low-temperature fixability and post-fixing separability are not achieved simultaneously in a satisfactory manner.

CITATION LIST

Patent Literature

Patent Literature 1: Japanese Patent No. 4665707

Patent Literature 2: Japanese Patent Application Laid-Open No. 2012-63559

SUMMARY OF INVENTION

Technical Problem

The present invention has been made on the basis of the foregoing circumstances and has as its object the provision of a toner for electrostatic image development that has both sufficient low-temperature fixability and good post-fixing separability.

Solution to Problem

To achieve the above mentioned object, a toner for electrostatic image development reflecting one aspect of the present invention comprises toner particles having a wax and a binder resin containing a crystalline polyester resin, a first amorphous polyester resin and a second amorphous polyester resin, wherein the crystalline polyester resin is obtained by polymerization of at least a diol component and a dicarboxylic acid component, the diol component includes an aliphatic diol having a straight carbon chain with 6 to 12 carbon atoms, the dicarboxylic acid component includes an aliphatic dicarboxylic acid having a straight carbon chain with 6 to 12 carbon atoms excluding carbon atoms in carboxyl groups, the second amorphous polyester resin includes a structural unit derived from any of monomers represented by the following general formulas (1) to (3), and the first amorphous polyester resin includes no structural unit derived from any of the monomers represented by the following general formulas (1) to (3):

General Formula (1)

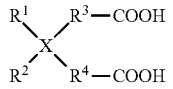

General Formula (2)

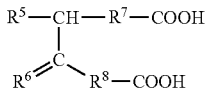

General Formula (3)

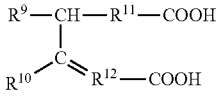

[wherein, in the general formulas (1) to (3), $R^1$, $R^2$, $R^5$, $R^9$ and $R^{10}$ are each independently an alkyl group having 4 to 15 carbon atoms or an alkenyl group having 4 to 15 carbon atoms, $R^3$, $R^4$, $R^7$, $R^8$ and $R^{11}$ are each independently an alkylene group having 4 to 14 carbon atoms or an alkenylene group having 4 to 14 carbon atoms, $R^6$ is a saturated or unsaturated divalent aliphatic hydrocarbon group having 4 to 15 carbon atoms, and $R^2$ is a saturated or unsaturated trivalent aliphatic hydrocarbon group having 4 to 14 carbon atoms, and, in the general formula (1), X is an aromatic ring, a carbocyclic ring or a group represented by the following formula (A)].

Formula (A)

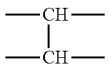

In the toner for electrostatic image development as above, the structural unit constituting the second amorphous polyester resin and derived from any of the monomers represented by the general formulas (1) to (3) may preferably be a structural unit derived from any of monomers represented by the following formulas (a) to (1).

Formula (a)

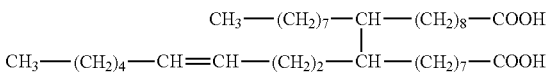

-continued

Formula (b)

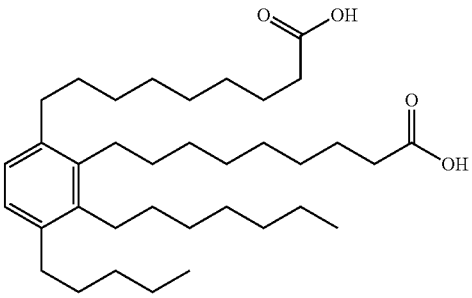

Formula (c)

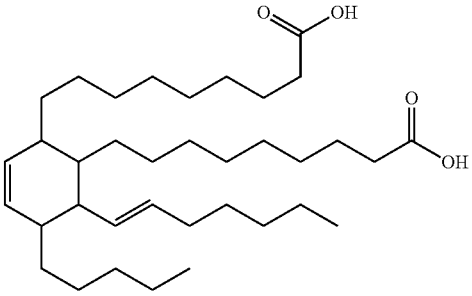

Formula (d)

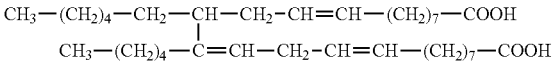

Formula (e)

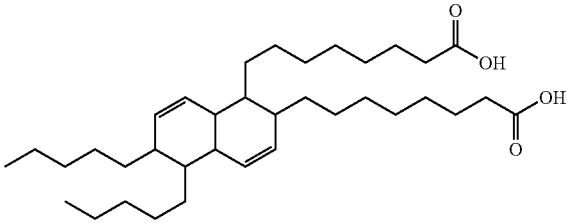

Formula (f)

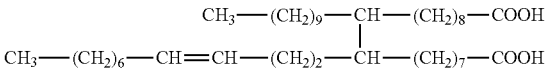

Formula (g)

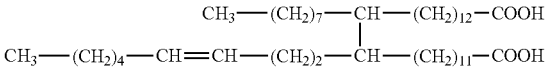

Formula (h)

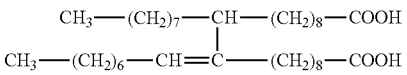

Formula (i)

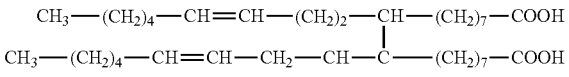

-continued

Formula (j)

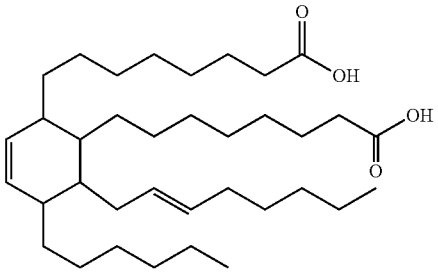

Formula (k)

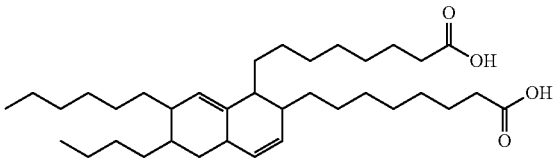

Formula (l)

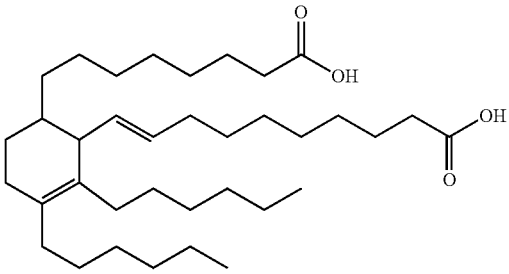

In the toner for electrostatic image development as above, the second amorphous polyester resin may preferably include a structural unit derived from terephthalic acid, a structural unit derived from a propylene oxide adduct of bisphenol A and a structural unit derived from an ethylene oxide adduct of bisphenol A.

In the toner for electrostatic image development as above, the first amorphous polyester resin may preferably include a structural unit derived from terephthalic acid, a structural unit derived from a propylene oxide adduct of bisphenol A and a structural unit derived from an ethylene oxide adduct of bisphenol A.

In the toner for electrostatic image development as above, the second amorphous polyester resin may preferably include a structural unit derived from an aliphatic diol.

In the toner for electrostatic image development as above, the wax may preferably be a hydrocarbon wax.

In the toner for electrostatic image development as above, the mass ratio of the content of the first amorphous polyester resin to the content of the second amorphous polyester resin, i.e., (the first amorphous polyester resin:the second amorphous polyester resin), is preferably 95:5 to 60:40.

In the toner for electrostatic image development as above, the molecular weight of the first amorphous polyester resin measured by gel permeation chromatography (GPC) is preferably 5,000 to 100,000, in terms of the weight average molecular weight (Mw).

In the toner for electrostatic image development as above, the molecular weight of the second amorphous polyester resin measured by gel permeation chromatography (GPC) is preferably 1,000 to 10,000, in terms of the weight average molecular weight (Mw).

In the toner for electrostatic image development as above, the glass transition point of the first amorphous polyester resin is preferably 40 to 90° C.

In the toner for electrostatic image development as above, the glass transition point of the second amorphous polyester resin is preferably 20 to 90° C.

In the toner for electrostatic image development as above, the melting point of the crystalline polyester resin is preferably 40 to 90° C.

In the toner for electrostatic image development as above, the content of the crystalline polyester resin in the binder resin is preferably 3 to 30% by mass.

In the toner for electrostatic image development as above, the content of the wax is preferably 1 to 30 parts by mass per 100 parts by mass of the binder resin.

Advantageous Effects of Invention

The toner for electrostatic image development according to the present invention contains a crystalline polyester resin, a first amorphous polyester resin and a wax and also contains a second amorphous polyester resin including a structural unit derived from any of monomers represented by the general formulas (1) to (3) above (these monomers may be referred to as "specific dimer acids"). Therefore, both sufficient low-temperature fixability and good post-fixing separability can be obtained simultaneously.

DESCRIPTION OF EMBODIMENTS

The present invention will next be specifically described.

The toner of the present invention includes toner particles including a wax and a binder resin containing a crystalline polyester resin, a first amorphous polyester resin and a second amorphous polyester resin.

More specifically, the second amorphous polyester resin includes a structural unit derived from any of monomers (specific dimer acids) represented by the general formulas (1) to (3) above, and the first amorphous polyester resin includes no structural units derived from the specific dimer acids.

The toner described above contains the crystalline polyester resin, the first amorphous polyester resin and the wax and also contains the second amorphous polyester resin including a structural unit derived from a specific dimer acid. Therefore, both sufficient low-temperature fixability and good post-fixing separability can be obtained simultaneously.

This may be because of the following reasons. Since the number of carbon atoms in each carbon chain ($R^3$, $R^4$, $R^7$, $R^8$, $R^{11}$ or $R^{12}$ in the general formulas (1) to (3)) in a main chain of a structural unit derived from a specific dimer acid and constituting the second amorphous polyester resin is relatively large, the second amorphous polyester resin has a high affinity for the wax, particularly for a hydrocarbon wax. This suppresses bleeding of the wax, and the wax can be highly uniformly and finely dispersed in the binder resin. Therefore, when this toner is used to form an image, the wax is highly uniformly distributed near the surface of the toner image, and the amount of the wax present near the surface is sufficiently high. This may allow the wax to easily exude to the surface of the image during heat fixation, so that good post-fixing separability is obtained.

Since the structural unit derived from the specific dimer acid constituting the second amorphous polyester resin has two side chains ($R^1$ and $R^2$, $R^5$ and $R^6$, or $R^9$ and $R^{10}$ in the general formulas (1) to (3) above) per one structural unit, the second amorphous polyester resin has a very high affinity for the crystalline polyester resin. Therefore, bleeding of the crystalline polyester resin to the surface of the toner particles is prevented during production and storage of the toner, and the crystalline polyester resin may be reliably captured in the toner particles. This allows sufficient low-temperature fixability to be exerted.

The term "affinity" as used herein does not mean that a crystalline material and a resin are completely mixed with each other but means that materials having low compatibility with each other dissolve in each other on the molecular level at the boundary between particles.

Binder Resin:

The binder resin constituting the toner particles according to the present invention contains the crystalline polyester resin, the first amorphous polyester resin and the second amorphous polyester resin, and these resins may be used in combination with an additional resin.

As examples of the additional resin, may be mentioned: vinyl-based polymers such as a styrene resin, an acrylic resin and a styrene acrylic resin; olefin resins; silicone resins; amide resins; and epoxy resins. These may be used either singly or in any combination thereof.

Crystalline Polyester Resin:

The crystalline polyester resin constituting the toner particles according to the present invention is obtained by condensation polymerization of at least a diol component and a dicarboxylic acid component.

In the present invention, the crystalline polyester resin is a polyester resin showing a clear endothermic peak rather than a stepwise endothermic change in differential scanning calorimetry (DSC). Specifically, the clear endothermic peak is an endothermic peak with a half-value width of 15° C. or less in the differential scanning calorimetry (DSC) when the measurement is performed at a temperature increase rate of 10° C./min.

The diol component for forming the crystalline polyester resin includes an aliphatic diol having a linear carbon chain with 6 to 12 carbon atoms, and an additional diol may be used in combination with the aliphatic diol as needed. In the present invention, the aliphatic diol having a linear chain (linear aliphatic diol) is a diol having a structure in which OH groups are bonded to respective ends.

The number of diol components is not limited to one, and a mixture of two or more types of diol components may be used.

As examples of the linear aliphatic diol having 6 co 12 carbon atoms, may be mentioned 1,6-hexanediol, 1,7-heptanediol, 1,8-octanediol, 1,9-nonanediol, 1,10-decanediol, 1,11-undecanediol and 1,12-dodecanediol.

Preferably, the linear aliphatic diol used is a diol in which two OH groups are bonded to both ends of its carbon chain.

As examples of the additional diol, may be mentioned: linear aliphatic diols such as ethylene glycol, 1,3-propanediol, 1,4-butanediol, 1,5-pentanediol, 1,13-tridecanediol, 1,14-tetradecanediol, 1,15-pentadecanediol, 1,18-octadecanediol and 1,20-eicosanediol; and diols having a double bond such as 2-butene-1,4-diol, 3-hexene-1,6-diol and 4-octene-1,8-diol.

The dicarboxylic acid component for forming the crystalline polyester resin includes a linear aliphatic dicarboxylic acid having a carbon chain with 6 to 12 carbon atoms excluding carbon atoms included in the carboxyl groups, and an additional dicarboxylic acid may be used in combination with the linear aliphatic dicarboxylic acid as needed.

The number of dicarboxylic acid components is not limited to one, and a mixture of two or more types of dicarboxylic acid components may be used.

As examples of the linear aliphatic dicarboxylic acid having 6 to 12 carbon atoms, may be mentioned suberic acid, azelaic acid, sebacic acid, undecanedioic acid, dodecanedioic acid, 1,11-undecanedicarboxylic acid and 1,12-dodecanedicarboxylic acid.

Preferably, the linear aliphatic dicarboxylic acid used is a linear aliphatic dicarboxylic acid in which two COOH groups are bonded to respective ends of the carbon chain.

As examples of the additional dicarboxylic acid, may be mentioned: linear aliphatic dicarboxylic acids such as oxalic acid, malonic acid, succinic acid, glutaric acid, adipic acid, pimelic acid, 1,13-tridecanedicarboxylic acid, 1,14-tetradecanedicarboxylic acid, 1,16-hexadecanedicarboxylic acid and 1,18-octadecanedicarboxylic acid; and lower alkyl esters and acid anhydrides thereof.

No particular limitation is imposed on the process of producing the crystalline polyester resin, and the crystalline polyester resin can be produced by a general polyester polymerization process in which a dicarboxylic acid component and a diol component are reacted in the presence of a catalyst. Preferably, the crystalline polyester resin is, for example, produced by using one of direct polycondensation and transesterification according to the types of the monomers.

As examples of a catalyst usable for the production of the crystalline polyester resin, may be mentioned: titanium catalysts such as titanium tetraethoxide, titanium tetrapropoxide, titanium tetraisopropoxide and titanium tetrabutoxide; and tin catalysts such as dibutyl tin dichloride, dibutyl tin oxide and diphenyl tin oxide.

The ratio of use of the dicarboxylic acid component to the diol component, i.e., the equivalent ratio [OH]/[COOH] of the hydroxyl groups [OH] in the diol component to the carboxyl groups [COOH] in the dicarboxylic acid component, is preferably 1.5/1 to 1/1.5, more preferably 1.2/1 to 1/1.2.

The crystalline polyester resin used has a melting point of preferably 40 to 90° C., more preferably 55 to 80° C.

When the melting point of the crystalline polyester resin falls within the above range, sufficient low-temperature fixability and good heat resistant storage stability are reliably obtained. If the melting point of the crystalline polyester resin is excessively low, the thermal strength of the toner obtained is low, so that sufficient heat resistant storage stability may not be obtained. If the melting point of the crystalline polyester resin is excessively high, sufficient low-temperature fixability may not be obtained.

Here, the melting point of the crystalline polyester resin is measured specifically using a differential scanning calorimeter "DIAMOND DSC" (manufactured by PerkinElmer Co., Ltd.) under measurement conditions (heating-cooling conditions) including, in the following order, a first heating step of heating from 0° C. to 200° C. at a temperature increase rate of 10° C./min, a cooling step of cooling from 200° C. to 0° C. at a cooling rate of 10° C./min, and a second heating step of heating from 0° C. to 200° C. at a temperature increase rate of 10° C./min. The peak top temperature of an endothermic peak originating from the crystalline polyester resin in a DSC curve obtained in the first heating step in this measurement is used as the melting point. The procedure of the measurement is as follows. 3.0 mg of the crystalline polyester resin is sealed in an aluminum-made pan, and the pan is placed in a sample holder of the DIAMOND DSC. An empty aluminum-made pan is used as a reference.

The molecular weight, i.e., the weight average molecular weight (Mw), of the crystalline polyester resin measured by gel permeation chromatography (GPC) is preferably 5,000 to 100,000, more preferably 10,000 to 50,000.

When the weight average molecular weight (Mw) of the crystalline polyester resin falls within the above range, both sufficient low-temperature fixability and good heat resistant storage stability are obtained simultaneously in a reliable manner. If the weight average molecular weight (Mw) of the crystalline polyester resin is excessively high, sufficient low-temperature fixability may not be obtained. If the weight average molecular weight (Mw) of the crystalline polyester resin is excessively low, bleeding of the crystalline polyester resin occurs during storage, so that sufficient heat resistant storage stability may not be obtained.

The molecular weight is measured by GPC as follows. Specifically, the molecular weight is measured using an apparatus "HLC-8220" (manufactured by TOSOH Corporation) and a column "TSKGUARDCOLUMN+TSKGEL SUPER-HZM-M (three in series)" (manufactured by TOSOH Corporation) in the flow of tetrahydrofuran (THF) used as a carrier solvent at a flow rate of 0.2 mL/min while the temperature of the column is held at 40° C. The measurement sample (the crystalline polyester resin) is dissolved in tetrahydrofuran at a concentration of 1 mg/mL using an ultrasonic disperser. In this case, the dissolving treatment is performed at room temperature for 5 minutes. Next, the obtained solution is treated through a membrane filter having a pore size of 0.2 μm to obtain a sample solution, and 10 μL of the sample solution together with the above-described carrier solvent is injected into the apparatus. Detection is performed using a refractive index detector (RI detector), and the molecular weight distribution of the measurement sample is computed using a calibration curve determined using monodispersed polystyrene standard particles. Polystyrene samples manufactured by Pressure Chemical and having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$ are used as the standard polystyrene samples for the determination of the calibration curve. At least about 10 different types of standard polystyrene samples are used for the measurement to produce the calibration curve. The detector used is a refractive index detector.

The content of the crystalline polyester resin in the binder resin is preferably 3 to 30% by mass, more preferably 5 to 20% by mass.

When the content of the crystalline polyester resin in the binder resin is 3% by mass or more, sufficient low-temperature fixability can be reliable obtained. When the content of the crystalline polyester resin is 30% by mass or less, good heat resistant storage stability can be reliable obtained.

First Amorphous Polyester Resin:

The first amorphous polyester resin constituting the toner particles according to the present invention contains no structural units derived from the specific dimer acids.

In the present invention, an amorphous polyester resin is a polyester resin that is obtained by condensation polymerization of at least a polyhydric alcohol component and a polyvalent carboxylic acid component and shows no clear endothermic peak in measurement by differential scanning calorimetry (DSC).

The polyvalent carboxylic acid component used to form an amorphous polyester resin may be any of polyvalent carboxylic acids and their alkyl esters, acid anhydrides and acid chlorides, and the polyhydric alcohol component used may be any of polyhydric alcohols, their ester compounds and hydroxycarboxylic acids.

As examples of the polyvalent carboxylic acid, may be mentioned: divalent carboxylic acids such as oxalic acid, succinic acid, maleic acid, mesaconic acid, adipic acid, β-methyladipic acid, azelaic acid, sebacic acid, undecanedioic acid, dodecanedioic acid, undecanedicarboxylic acid, dodecanedicarboxylic acid, fumaric acid, citraconic acid, diglycolic acid, cyclohexane-3,5-diene-1,2-dicarboxylic acid, malic acid, citric acid, hexahydro-terephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracene dicarboxylic acid and dodecenyl succinic acid; and trivalent or higher carboxylic acids such as trimellitic acid, pyromellitic acid, naphthalene tricarboxylic acid, naphthalene tetracarboxylic acid, pyrene tricarboxylic acid and pyrene tetracarboxylic acid.

As examples of the polyhydric alcohol, may be mentioned: dihydric alcohols such as ethylene glycol, propylene glycol, butanediol, diethylene glycol, hexanediol, cyclohexanediol, octanediol, decanediol, dodecanediol, an ethylene oxide adduct of bisphenol A and a propylene oxide adduct of bisphenol A; and trihydric or higher alcohols such as glycerin, pentaerythritol, hexamethylolmelamine, hexaethylolmelamine, tetramethylolbenzoguanamine and tetraethylolbenzoguanamine.

In the toner particles according to the present invention, it is preferable that the first amorphous polyester resin includes a structural unit derived from terephthalic acid, a structural unit derived from a propylene oxide adduct of bisphenol A and a structural unit derived from an ethylene oxide adduct of bisphenol A.

More specifically, it is preferable that terephthalic acid is used as the polyvalent carboxylic acid component for forming the first amorphous polyester resin and a propylene oxide adduct of bisphenol A and an ethylene oxide adduct of bisphenol A are used as the polyhydric alcohol components.

With the toner containing such a first amorphous polyester resin, very good heat resistant storage stability is obtained.

No particular limitation is imposed on the process of producing the first amorphous polyester resin, and the first amorphous polyester resin can be produced by the same production process as the production process of the crystalline polyester resin described above.

The molecular weight, i.e., the weight average molecular weight (Mw), of the first amorphous polyester resin measured by gel permeation chromatography (GPC) is preferably 5,000 to 100,000, more preferably 5,000 to 50,000.

When the weight average molecular weight (Mw) of the first amorphous polyester resin falls within the above range, both sufficient low-temperature fixability and good heat resistant storage stability are obtained simultaneously in a reliable manner. If the weight average molecular weight (Mw) of the first amorphous polyester resin is excessively high, sufficient low-temperature fixability may not be obtained. If the weight average molecular weight (Mw) of the first amorphous polyester resin is excessively low, the first amorphous polyester resin and the crystalline polyester resin dissolve in each other during production and storage, so that sufficient heat resistant storage stability may not be obtained.

The molecular weight of the first amorphous polyester resin is measured by GPC in the same manner as described above except that the first amorphous polyester resin is used as the measurement sample.

The glass transition point of the first amorphous polyester resin is preferably 40 to 90° C., more preferably 45 to 85° C.

When the glass transition point of the first amorphous polyester resin falls within the above range, both sufficient low-temperature fixability and good heat resistant storage stability are obtained simultaneously in a reliable manner. However, if the glass transition point of the first amorphous polyester resin is excessively low, the thermal strength of the obtained toner becomes low. In this case, sufficient heat resistant storage stability may not be obtained, and a hot offset phenomenon may occur during heat fixation. If the glass transition point of the first amorphous polyester resin is excessively high, sufficient low-temperature fixability may not be obtained.

The glass transition point of the first amorphous polyester resin is a value measured according to a method specified in ASTM (American Society for Testing and Materials) D3418-82 (DSC method) using the first amorphous polyester resin as the measurement sample.

Second Amorphous Polyester Resin:

The second amorphous polyester resin constituting the toner particles according to the present invention includes a structural unit derived from a specific dimer acid. The second amorphous polyester resin may include, in addition to the structural unit derived from the specific dimer acid, the same structural units as those in the first amorphous polyester resin described above.

The second amorphous polyester resin functions as a dispersant for the wax and the crystalline polyester resin.

Specific Dimer Acid:

In the above general formulas (1) to (3) representing the specific dimer acids, $R^1$, $R^2$, $R^5$, $R^9$ and $R^{10}$ are each independently an alkyl group having 4 to 15 carbon atoms or an alkenyl group having 4 to 15 carbon atoms, and $R^3$, $R^4$, $R^7$, $R^8$ and $R^{11}$ are each independently an alkylene group having 4 to 14 carbon atoms or an alkenylene group having 4 to 14 carbon atoms. $R^6$ is a saturated or unsaturated divalent aliphatic hydrocarbon group having 4 to 15 carbon atoms, and $R^{12}$ is a saturated or unsaturated trivalent aliphatic hydrocarbon group having 4 to 14 carbon atoms. In the general formula (1), X is an aromatic ring, a carbocyclic ring or a group represented by the above formula (A).

Each of the groups $R^1$ to $R^{22}$ does not have a substituent.

In the present invention, the carbocyclic ring means a saturated or unsaturated cyclic structure formed of carbon atoms and having no aromaticity.

When the numbers of carbon atoms in carbon chains ($R^3$, $R^4$, $R^7$, $R^8$, $R^{11}$ and $R^{12}$) constituting the main chains of the specific dimer acids fall within the above ranges and the numbers of carbon atoms in side chains ($R^1$, $R^2$, $R^5$, $R^6$, $R^9$ and $R^{10}$) fall within the above ranges, the second amorphous polyester resin can have a high affinity for crystalline materials such as the crystalline polyester resin and the wax.

If carbon chains in the main and side chains in a specific dimer acid are excessively short, a sufficient affinity for the crystalline materials is not obtained, and bleeding of these materials may not be sufficiently suppressed. If the carbon chains are excessively long, the glass transition point of the second amorphous polyester resin becomes low, and sufficient heat resistant storage stability may not be ensured.

As specific examples of the specific dimer acids, may be mentioned those exemplified in the above formulas (a) to (1).

The ratio of the specific dimer acid used with respect to the polyvalent carboxylic acid components for forming the second amorphous polyester resin is preferably 1 to 40% by mass, more preferably 5 to 30% by mass.

In the toner particles according to the present invention, it is preferable that the second amorphous polyester resin includes a structural unit derived from an alicyclic diol such as cyclohexanediol, cyclohexanedimethanol or isosorbide. More specifically, it is preferable to use an alicyclic diol as a polyhydric alcohol component for forming the second amorphous polyester resin.

The second amorphous polyester resin including the structural unit derived from such an alicyclic diol has excellent flexibility, and therefore the low-temperature fixability of the toner can be improved.

In the toner particles according to the present invention, it is preferable that the second amorphous polyester resin includes a structural unit derived from terephthalic acid, a structural unit derived from a propylene oxide adduct of bisphenol A and a structural unit derived from an ethylene oxide adduct of bisphenol A.

More specifically, it is preferable that a specific dimer acid and terephthalic acid are used as the polyvalent carboxylic acid components for forming the second amorphous polyester resin and a propylene oxide adduct of bisphenol A and an ethylene oxide adduct of bisphenol A are used as the polyhydric alcohol components.

In the toner containing the above described second amorphous polyester resin, a high affinity for the first amorphous polyester resin is obtained, and therefore the first amorphous polyester resin is highly uniformly dispersed in the toner particles, so that the crystalline materials can be highly uniformly dispersed in the toner particles.

The molecular weight, i.e., the weight average molecular weight (Mw), of the second amorphous polyester resin measured by gel permeation chromatography (GPC) is preferably 1,000 to 10,000, more preferably 1,000 to 5,000.

When the weight average molecular weight (Mw) of the second amorphous polyester resin falls within the above range, both sufficient low-temperature fixability and good heat resistant storage stability are obtained simultaneously in a reliable manner. If the weight average molecular weight (Mw) of the second amorphous polyester resin is excessively high, sufficient low-temperature fixability may not be obtained. If the weight average molecular weight (Mw) of the second amorphous polyester resin is excessively low, sufficient heat resistant storage stability during storage may not be obtained.

The molecular weight of the second amorphous polyester resin is measured by GPC in the same manner as described above except that the second amorphous polyester resin is used as the measurement sample.

The glass transition point of the second amorphous polyester resin is preferably 20 to 90° C., more preferably 30 to 70° C.

When the glass transition point of the second amorphous polyester resin falls within the above range, both sufficient low-temperature fixability and good heat resistant storage stability are obtained simultaneously in a reliable manner. However, if the glass transition point of the second amorphous polyester resin is excessively low, the thermal strength of the obtained toner becomes low. In this case, sufficient heat resistant storage stability may not be obtained, and a hot offset phenomenon may occur during heat fixation. If the glass transition point of the second amorphous polyester resin is excessively high, sufficient low-temperature fixability may not be obtained.

The glass transition point of the second amorphous polyester resin is a value measured according to a method specified in ASTM (American Society for Testing and Materials) D3418-82 (DSC method) using the second amorphous polyester resin as the measurement sample.

The mass ratio of the content of the first amorphous polyester resin to the content of the second amorphous polyester resin, i.e., (first amorphous polyester resin:second amorphous polyester resin), is preferably 95:5 to 60:40, more preferably 90:10 to 70:30.

When the ratio of the first amorphous polyester resin with respect to the total amount of the amorphous polyester resins is 95% by mass or less, the amount of the second amorphous polyester resin is ensured, and the crystalline materials can be highly uniformly dispersed in the toner particles. Therefore, bleeding of the crystalline materials can be suppressed in a reliable manner, and both sufficient low-temperature fixability and good post-fixing separability are obtained simultaneously. When the ratio of the first amorphous polyester resin with respect to the total amount of the amorphous polyester resins is 60% by mass or more, good heat resistant storage stability can be reliably obtained.

Wax:

No particular limitation is imposed on the wax, and various types thereof may be used. As examples of the wax, may be mentioned: polyolefin waxes such as polyethylene wax and polypropylene wax; branched chain hydrocarbon waxes such as Fischer-Tropsch wax and microcrystalline wax; long chain hydrocarbon-based waxes such as paraffin wax and Sasol wax; dialkyl ketone-based waxes such as distearyl ketone; ester-based waxes such as carnauba wax, montan wax, behenic acid behenate, trimethylolpropane tribehenate, pentaerythritol tetrabehenate, pentaerythritol diacetate dibehenate, glycerin tribehenate, 1,18-octadecanediol distearate, tristearyl trimellitate and distearyl maleate; and amide-based waxes such as ethylenediamine behenylamide and tristearyl trimellitate amide.

Particularly preferably, the wax used is a hydrocarbon wax.

The hydrocarbon wax used has a carbon number distribution of preferably 20 to 100, more preferably 30 to 70.

When the hydrocarbon wax used has a carbon number distribution of 20 to 100, sufficient post-fixing separability is obtained, and the amount of the wax volatilized can be reduced.

The content of the wax is preferably 1 to 30 parts by mass, more preferably 5 to 20 parts by mass per 100 parts by mass of the binder resin. When the content of the wax falls within the above range, good post-fixing separability is reliably obtained.

Components Constituting Toner Particles:

The toner particles according to the present invention may optionally contain, in addition to the binder resin and the wax, internal additives such as a colorant and a charge control agent.

Colorant:

Any of the commonly known dyes and pigments can be used as the colorant.

As a colorant used to obtain a black toner, any of various publicly known colorants such as carbon blacks (for example, furnace black and channel black), magnetic substances (for example, magnetite and ferrite), dyes and inorganic pigments containing nonmagnetic iron oxide may be used.

As a colorant used to obtain a color toner, any of the publicly known colorants such as dyes and organic pigments may be used. As specific examples of the organic pigments, may be mentioned C.I. Pigment Red: 5, 48:1, 48:2, 48:3, 53:1, 57:1, 81:4, 122, 139, 144, 149, 166, 177, 178, 222, 238 and 269, C.I. Pigment Yellow: 14, 17, 74, 93, 94, 138, 155, 180 and 185, C.I. Pigment Orange: 31 and 43 and C.I. Pigment Blue: 15:3, 60 and 76. As specific examples of the dyes, may be mentioned C.I. Solvent Red: 1, 49, 52, 58, 68, 11 and 122, C.I. Solvent Yellow 19, 44, 77, 79, 81, 82, 93, 98, 103, 104, 112 and 162 and C.I. Solvent Blue 25, 36, 69, 70, 93 and 95.

One colorant or a combination of two or more colorants may be used for a color toner.

The content of the colorant is preferably 1 to 20 parts by mass, more preferably 4 to 15 parts by mass per 100 parts by mass of the binder resin.

Charge Control Agent:

The charge control agent used may be any of various publicly known compounds.

The content of the charge control agent is generally 0.1 to 5.0 parts by mass per 100 parts by mass of the binder resin.

The toner particles according to the present invention may have a core-shell structure in which the surface of core particles is coated with a shell layer.

When the toner particles have the core-shell structure, the crystalline polyester resin, the first amorphous polyester resin and the second amorphous polyester resin may be contained in any of the core particles and/or the shell layer.

In the toner particles having the core-shell structure, the surface of the core particles may be fully coated with the shell layer, or only part of the surface of the core particles may be coated with the shell layer. The shell layer may have a multilayer structure including two or more layers composed of resins with different compositions.

Average Particle Diameter of Toner:

The average particle diameter (for example, volume-based median diameter) of the toner of the present invention is preferably 3 to 9 μm, more preferably 3 to 8 μm. When the toner is produced using, for example, emulsion aggregation process described later, the particle diameter can be controlled by changing the concentration of an aggregating agent used, the amount added of an organic solvent, fusion-bonding time, the compositions of the polymers, etc.

When the volume-based median diameter falls within the above range, transfer efficiency is high, and the quality of a halftone image is improved, resulting in an improvement in the image quality of fine lines and dots.

The volume-based median diameter of the toner particles is measured and computed using a measuring device composed of "MULTISIZER 3" (manufactured by Beckman Coulter, Inc.) and a computer system connected thereto and equipped with data processing software "Software V3.51." More specifically, 0.02 g of the toner is added to 20 mL of a surfactant solution (a surfactant solution used for the purpose of dispersing the toner particles and prepared, for example, by diluting a neutral detergent containing a surfactant component tenfold with pure water) and is left to stand. The obtained solution is subjected to ultrasonic dispersion for 1 minute to prepare a dispersion of the toner. This toner dispersion is added with a pipette to a beaker containing "ISOTON II" (manufactured by Beckman Coulter, Inc.) and held in a sample stand until the concentration displayed in the measuring device reaches 8%. By using the above concentration range, a reproducible measurement value can be obtained. In the measuring device, the number of particles to be counted is set to 25,000, and the diameter of an aperture is set to 50 μm. The range of measurement, a 1 to 30 μm range, is divided into 256 sections, and a frequency value in each section is computed. The particle size when a cumulative volume fraction cumulated from the large-diameter side reaches 50% is used as the volume-based median diameter.

Average Circularity of Toner Particle:

In the toner of the present invention, the average circularity of the toner particles constituting the toner is preferably 0.930 to 1.000, more preferably 0.940 to 0.995 from the viewpoint of transfer efficiency.

The average circularity of the toner particles is a value measured using "FPIA-2100" (manufacture by Sysmex Corporation).

More specifically, a measurement sample (the toner particles) is left to stand in a surfactant-containing aqueous solution and then subjected to ultrasonic dispersion treatment for 1 minute to disperse the toner particles. Then images of the toner particles are taken using the "FPIA-210C" (manufacture by Sysmex Corporation) in an HPF (high-power field) measurement mode at an appropriate concentration in which the number of toner particles detected in the HPF mode is 3,000 to 10,000. The circularity of each of the toner particles is computed using the following formula (T). The computed circularity values of the toner particles are summed up, and the sum total is divided by the total number of toner particles to compute the average circularity.

circularity=(the circumferential length of a circle having the same area as the projected area of a particle image)/(the circumferential length of the projected particle image) Formula (T)

Softening Point of Toner:

The softening point of the toner is preferably 70 to 120° C., more preferably 80 to 110° C., from the viewpoint of allowing the toner to have low-temperature fixability.

The softening point of the toner is a value measured by the following flow tester.

First, 1.1 g of a measurement sample (the toner) is placed in a petri dish in an environment of 20:1° C. and 50±5% RH and then is leveled off. After left to stand for 12 hours or longer, the measurement sample is pressurized using a press "SSP-10A" (manufactured by Shimadzu Corporation) at a pressure of 3,820 kg/cm$^2$ for 30 seconds to produce a cylindrical molded sample having a diameter of 1 cm. Then the molded sample is placed in a flow tester "CFT-500D" (manufactured by Shimadzu Corporation) in an environment of 24° C. and 50% RH. Under the conditions of a load of 196 N (20 kgf), a start temperature of 60° C., a preheating time of 300 seconds and a temperature increase rate of 6° C./min, the molded sample is extruded from the hole (1 mm diameter×1 mm) of a cylindrical die using a piston having a diameter of 1 cm after completion of preheating. An offset temperature $T_{offset}$ measured by a melting point measurement method using a temperature rise method at an offset value setting of 5 mm is used as the softening point.

Glass Transition Point of Toner:

The glass transition point of the toner is preferably 30 to 70° C., more preferably 40 to 60° C.

The glass transition point of the binder resin as a whole is a value measured according to a method specified in ASTM (American Society for Testing and Materials) D3418-82 (DSC method) using the binder resin as the measurement sample.

Production Process of Toner:

As examples of the production process of the toner of the present invention, may be mentioned a kneading-pulverizing process, a suspension polymerization process, an emulsion polymerization process, an emulsion aggregation process, an emulsion polymerization aggregation process, a miniemulsion polymerization aggregation process, an encapsulation process and other well-known processes. Particularly preferably, an emulsion aggregation process is used, in which the resins constituting the binder resin (the crystalline polyester resin, the first amorphous polyester resin and the second amorphous polyester resin) and fine wax particles are aggregated and fusion-bonded to obtain toner particles.

In the emulsion aggregation process, dispersions of fine particles of the resins constituting the binder resin are mixed with a dispersion of fine wax particles and, if necessary, with a dispersion of fine particles of other components of the toner particles. These particles are slowly aggregated while the balance between repulsion between the surfaces of the fine particles and the cohesion of the fine particles is adjusted. The repulsion can be controlled by pH adjustment, and the cohesion can be controlled by addition of an aggregating agent formed of an electrolyte. These particles are associated while the average particle diameter and the particle size distribution are controlled. At the same time, the mixture is heated and stirred so that the fine particles are fusion-bonded to thereby control their shape, whereby toner particles are produced.

When the toner particles contain a colorant and a charge control agent, fine particles of the colorant and the charge control agent are aggregated together with the fine particles of the crystalline polyester resin and other components.

External Additives:

The above-described toner particles can constitute the toner of the present invention without adding any additives. However, to improve flowability, charge property characteristics, cleanability, etc., external additives such as a flowability improver and a cleaning aid (post treatment agents) may be added to the toner particles to thereby form the toner of the present invention.

As examples of the post treatment agent, may be mentioned: fine inorganic oxide particles such as fine silica particles, fine alumina particles and fine titanium oxide particles; fine inorganic stearate compound particles such as fine aluminum stearate particles and fine zinc stearate particles; and fine inorganic titanate compound particles such as strontium titanate particles and zinc titanate particles. These may be used either singly or in any combination thereof.

Preferably, these fine inorganic particles have been subjected to surface treatment with a silane coupling agent, a titanium coupling agent, a higher fatty acid, or silicone oil, in order to improve heat resistant storage stability and to improve environmental stability.

The total amount added of these various external additives is preferably 0.05 to 5 parts by mass, preferably 0.1 to 3 parts by mass per 100 parts by mass of the toner. A combination of various external additives may also be used.

The toner of the present invention contains the crystalline polyester resin, the first amorphous polyester resin and the wax and also contains the second amorphous polyester resin including a structural unit derived from a specific dimer acid. Therefore, both sufficient low-temperature fixability and good post-fixing separability can be obtained simultaneously.

Developer:

The toner of the present invention can be used as a magnetic or non-magnetic one-component developer or may be mixed with a carrier and used as a two-component developer.

Magnetic particles composed of a publicly known material such as a metal (for example, iron, ferrite or magnetite) or an alloy of one of these metals and another metal such as aluminum or lead can be used as the carrier. Of these, ferrite particles are particularly preferred. In addition, the carrier used may be any of a coated carrier obtained by coating the surface of magnetic particles with a coating such as a resin and a resin-dispersed carrier obtained by dispersing fine magnetic particles in a binder resin.

The volume average particle diameter of the carrier used is preferably 15 to 100 μm, more preferably 25 to 80 μm.

Image Forming Apparatus:

The toner of the present invention can be used for a commonly used image forming method of an electrophotographic system. Example of an image forming apparatus performing such an image forming method of an electrophotographic system can include: a photoreceptor used as a static latent image carrier; an electrification unit for generating corona discharge with the same polarity as that of the toner to create a uniform potential on the surface of the photoreceptor; an exposure unit for performing image exposure on the surface of the uniformly charged photoreceptor according to image data to thereby form a static latent image; a developing unit for conveying the toner to the surface of the photoreceptor to visualize the static latent image to thereby form a toner image; a transfer unit for transferring the toner image to a transfer medium, if necessary, through an intermediate transfer member; and a fixing unit for heating and fixing the toner image on the transfer medium.

The toner of the present invention can be preferably used for an image forming apparatus in which fixation temperature (the surface temperature of a fixation member) is relatively low, for example, 100 to 200° C.

The embodiments of the present invention have been specifically described. However, the embodiments of the present invention are not limited to the examples described above, and various modifications can be made thereto.

EXAMPLES

Specific examples of the present invention will next be described, but the present invention is not limited thereto.

Synthesis Example of Amorphous Polyester Resin [A1]

A reaction vessel equipped with a stirrer, a thermometer, a condenser tube and a nitrogen introduction tube was charged with 85 parts by mass of terephthalic acid, 6 parts by mass of trimellitic acid, 90 parts by mass of fumaric acid, 381 parts by mass of a propylene oxide adduct of bisphenol A and 62 parts by mass of an ethylene oxide adduct of bisphenol A, and inside air of the reaction vessel was replaced with dry nitrogen gas. Then 0.1 parts by mass of titanium tetrabutoxide was added, and the mixture was stirred at about 180° C. under nitrogen gas flow for 8 hours to allow a reaction to proceed. 0.2 Parts by mass of titanium tetrabutoxide was further added, and the temperature was increased to about 220° C. The mixture was stirred for 6 hours to allow the reaction to proceed. Then the pressure inside the reaction vessel was reduced to 10 mm Hg, and the reaction was allowed to proceed under reduced pressure to obtain an amorphous polyester resin [A1].

The glass transition point (Tg) of the amorphous polyester resin [A1] was 59° C., and its weight average molecular weight (Mw) was 18,000.

Synthesis Example of Amorphous Polyester Resin [A2]

An amorphous polyester resin [A2] was obtained in the same manner as in the synthesis example of amorphous polyester resin [A1] except that the monomers used were changed to 85 parts by mass of terephthalic acid, 6 parts by mass of isophthalic acid, 64 parts by mass of fumaric acid, 385 parts by mass of a propylene oxide adduct of bisphenol A and 58 parts by mass of an ethylene oxide adduct of bisphenol A.

The glass transition point (Tg) of the amorphous polyester resin [A2] was 59° C., and its weight average molecular weight (Mw) was 19,000.

Synthesis Example of Amorphous Polyester Resin [B1]

A reaction vessel equipped with a stirrer, a thermometer, a condenser tube and a nitrogen introduction tube was charged with 110 parts by mass of terephthalic acid, 40 parts by mass of a specific dimer acid represented by the formula (a) above, 190 parts by mass of a propylene oxide adduct of bisphenol A and 31 parts by mass of an ethylene oxide adduct of bisphenol A, and inside air of the reaction vessel was replaced with dry nitrogen gas. Then 0.1 parts by mass of titanium tetrabutoxide was added, and the mixture was stirred at about 180° C. under nitrogen gas flow for 8 hours to allow a reaction to proceed. 0.2 Parts by mass of titanium tetrabutoxide was further added, and the temperature was increased to about 220° C. The mixture was stirred for 6 hours to allow the reaction to proceed. Then the pressure inside the reaction vessel was reduced to 10 mm Hg, and the reaction was allowed to proceed under reduced pressure to obtain an amorphous polyester resin [B1].

Synthesis Examples of Amorphous Polyester Resins [B2] to [B12]

Amorphous polyester resins [B2] to [B12] were obtained in the same manner as in the synthesis example of amorphous polyester resin [B1] except that one of the specific dimer acids represented by the formulas (b) to (1) above was used instead of the specific dimer acid represented by the formula (a) above.

Synthesis Example of Amorphous Polyester Resin [B13]

A reaction vessel equipped with a stirrer, a thermometer, a condenser tube and a nitrogen introduction tube was charged with 110 parts by mass of terephthalic acid, 40 parts by mass of the specific dimer acid represented by the formula (a) above, 160 parts by mass of a propylene oxide adduct of bisphenol A, 31 parts by mass of an ethylene oxide adduct of bisphenol A and 30 parts by mass of isosorbide, and inside air of the reaction vessel was replaced with dry nitrogen gas. Then 0.1 parts by mass of titanium tetrabutoxide was added, and the mixture was stirred at about 180° C. under nitrogen gas flow for 8 hours to allow a reaction to proceed. 0.2 Parts by mass of titanium tetrabutoxide was further added, and the temperature was increased to about 220° C. The mixture was stirred for 6 hours to allow the reaction to proceed. Then the pressure inside the reaction vessel was reduced to 13 mm Hg, and the reaction was allowed to proceed under reduced pressure to obtain an amorphous polyester resin [B13].

Synthesis Example of Crystalline Polyester Resin [C1]

A reaction vessel equipped with a stirrer, a thermometer, a condenser tube and a nitrogen introduction tube was charged with 315 parts by mass of dodecanedioic acid and 220 parts by mass of 1,9-nonanediol, and inside air of the reaction vessel was replaced with dry nitrogen gas. Then 0.1 parts by mass of titanium tetrabutoxide was added, and the mixture was stirred at about 180° C. under nitrogen gas flow for 8 hours to allow a reaction to proceed. 0.2 Parts by mass of titanium tetrabutoxide was further added, and the temperature was increased to about 220° C. The mixture was stirred for 6 hours to allow the reaction to proceed. Then the pressure inside the reaction vessel was reduced to 10 mm Hg, and the reaction was allowed to proceed under reduced pressure to obtain a crystalline polyester resin [C1].

The melting point (Tm) of the crystalline polyester resin [C1] was 72° C., and its weight average molecular weight (Mw) was 14,000.

Synthesis Examples of Crystalline Polyester Resins [C2] to [C4]

Crystalline polyester resins [C2] to [C4] were obtained in the same manner as in the synthesis example of crystalline polyester resin [C1] except that one of combinations of the dicarboxylic acid component and diol component at a molar ratio of 1:1 shown in TABLE 1 was used.

TABLE 1

| CRYSTALLINE POLYESTER RESIN NO. | DICARBOXYLIC ACID COMPONENT | DIOL COMPONENT |
|---|---|---|
| [C1] | DODECANEDIOIC ACID | 1,9-NONANEDIOL |
| [C2] | DODECANEDIOIC ACID | 1,6-HEXANEDIOL |
| [C3] | SUBERIC ACID | 1,12-DODECANEDIOL |
| [C4] | TETRADECANEDIOIC ACID | 1,6-HEXANEDIOL |

Preparation Example of Dispersion of Fine Particles of Amorphous Polyester Resin [A1]

200 Parts by mass of the amorphous polyester resin [A1] was dissolved in 200 parts by mass of ethyl acetate. Then an aqueous solution prepared by dissolving sodium polyoxyethylene lauryl ether sulfate in 800 parts by mass of ion exchanged water at a concentration of 1% by mass was slowly added dropwise to the obtained solution under stirring. Ethyl acetate was removed from the resultant solution under reduced pressure, and the pH of the solution was adjusted to 8.5 with ammonia. Then the concentration of solids was adjusted to 20% by mass. A dispersion of fine particles of the amorphous polyester resin [A1] in which the fine particles of the amorphous polyester resin [A1] were dispersed in the water-based medium was thereby prepared.

Preparation Examples of Dispersions of Fine Particles of Amorphous Polyester Resins [A2] and [B1] to [B13] and Dispersions of Fine Particles of Crystalline Polyester Resins [C1] to [C4]

Dispersions of fine particles of the amorphous polyester resins [A2] and [B1] to [B13] and dispersions of fine particles of the crystalline polyester resins [C1] to [C4] were prepared in the same manner as in the preparation example of the dispersion of the fine particles of the amorphous polyester resin [A1] except that one of the amorphous polyester resins [A2] and [B1] to [B13] and the crystalline polyester resin [C1] to [C4] was used instead of the amorphous polyester resin [A1].

Preparation Example of Dispersion of Colorant

50 Parts by mass of copper phthalocyanine (C.I. Pigment Blue 15:3) was added to an aqueous surfactant solution prepared by dissolving sodium alkyl diphenyl ether disulfonate in 200 parts by mass of ion exchanged water at a concentration of 1% by mass, and then the mixture was subjected to dispersion treatment using an ultrasonic homogenizer. The concentration of solids was adjusted to 20% by mass. A colorant dispersion in which fine colorant particles were dispersed in the water-based medium was thereby prepared.

The volume-based median diameter of the fine colorant particles in the colorant dispersion was measured using a Microtrac particle size distribution measurement device "UPA-150" (manufactured by NIKKISO Co., Ltd.) and was found to be 150 nm.

Preparation Example of Dispersion of Wax

200 Parts by mass of Fischer-Tropsch wax "FNP-0090" (manufactured by Nippon Seiro Co., Ltd., melting point: 89° C.) was heated and melted at 95° C. The molten wax was added to an aqueous surfactant solution prepared by dissolving sodium alkyl diphenyl ether disulfonate in 800 parts by mass of ion exchanged water at a concentration of 3% by mass, and then the mixture was subjected to dispersion treatment using an ultrasonic homogenizer. The concentration of solids was adjusted to 20% by mass. A wax dispersion in which fine wax particles were dispersed in the water-based medium was thereby prepared.

The volume-based median diameter of the fine wax particles in the wax dispersion was measured using a Microtrac particle size distribution measurement device "UPA-150" (manufactured by NIKKISO Co., Ltd.) and was found to be 190 nm.

Example 1

A reaction vessel equipped with a stirrer, a condenser tube and a thermometer was charged with 276 parts by mass of the dispersion of the amorphous polyester resin [A1], 69 parts by mass of the dispersion of the amorphous polyester resin [B1], 86.4 parts by mass of the dispersion of the crystalline polyester resin [C1], 77.3 parts by mass of the wax dispersion, 41.3 parts by mass of the colorant dispersion, 225 parts by mass of ion exchanged water and 2.5 parts by mass of sodium polyoxyethylene lauryl ether sulfate, and 0.1N hydrochloric acid was added under stirring to adjust the pH of the mixture to 2.5.

Next, 0.3 parts by mass of an aqueous poly-aluminum chloride solution (a 10% aqueous solution in terms of $AlCl_3$) was added dropwise over 10 minutes, and the temperature inside the vessel was increased to 60° C. under stirring. The temperature was further gradually increased to 75° C., and the temperature inside the vessel was maintained at 75° C. Then measurement was performed using a COULTER COUNTER. When the average particle diameter reached 6 μm or larger, 2 parts by mass of an aqueous solution of tetrasodium 3-hydroxy-2,2'-iminodisuccinate (a 40% aqueous solution) was added to terminate particle growth. Then the temperature inside the vessel was increased to 85° C. When the shape factor measured using "FPIA-2000" reached 0.96, the mixture was cooled to room temperature at a rate of 10° C./min. The reaction mixture was repeatedly filtrated and washed and then dried to obtain toner particles [1].

1% by mass of hydrophobic silica (number average primary particle diameter=12 nm, degree of hydrophobization=68) and 1% by mass of hydrophobic titanium oxide (number average primary particle diameter=20 nm, degree of hydrophobization=63) were added to the obtained toner particles [1], and these were mixed using a "HENSCHEL MIXER" (manufactured by Mitsui Miike Engineering Corporation). Then coarse particles were removed using a sieve with an opening of 45 μm to obtain a toner [1].

The volume-based median diameter of the toner [1] was 6.10 μm, and its average circularity was 0.965.

Examples 2 to 13

Toners [2] to [13] were obtained in the same manner as in Example 1 except that one of compositions in TABLE 2 was used.

Comparative Example 1

A reaction vessel equipped with a stirrer, a condenser tube and a thermometer was charged with 345.6 parts by mass of the dispersion of the amorphous polyester resin [A1], 86.4 parts by mass of the dispersion of the crystalline polyester resin [C1], 77.3 parts by mass of the wax dispersion, 41.3 parts by mass of the colorant dispersion, 225 parts by mass of ion exchanged water and 2.5 parts by mass of sodium polyoxyethylene lauryl ether sulfate, and 0.1N sodium hydroxide was added under stirring to adjust the pH of the mixture to 10.

The step of adding an aqueous poly-aluminum chloride solution dropwise and the subsequent steps were performed as in Example 1 to obtain a toner [14].

The volume-based median diameter of the toner [14] was 6.15 μm, and its average circularity was 0.964.

Comparative Example 2

A toner [15] was obtained in the same manner as in Comparative Example 1 except that the dispersion of the amorphous polyester resin [B1] was used instead of the dispersion of the amorphous polyester resin [A1].

Comparative Example 3

A toner [16] was obtained in the same manner as in Example 1 except that the dispersion of the amorphous polyester resin [A2] was used instead of the dispersion of the amorphous polyester resin [B1].

Production Examples 1 to 16 of Developer

Developers [1] to [16] were produced by adding a ferrite carrier having a volume-based average diameter of 60 μm and coated with a silicone resin to each of the toners [1] to [16] such that the concentration of the toner was 6% and then mixing them.

The developers [1] to [16] were evaluated as follows.

(1) Low-Temperature Fixability:

A fixation experiment was performed using a commercial multi-function full color printer-copier "BIZHUB PRO C6501" (manufactured by Konica Minolta Inc.) including a fixing unit modified such that the surface temperature of a fixation heating roller could be changed within the range of 100 to 210° C. In the fixation experiment, one of the above developers was installed in the copier, and a solid image with a toner adhesion amount of 11 mg/10 $cm^2$ was fixed on an A4 plain paper sheet (basis weight: 80 $g/m^2$). The fixation experiment was repeated at different fixation temperature settings. More specifically, the fixation temperature was increased from 100° C. to 105° C. in steps of 5° C.

Then a printed sheet obtained in each of the fixation experiments at different fixation temperatures was folded using a folding machine with a load applied to the solid image. Compressed air at 0.35 MPa was blown onto the folded sheet, and the fold was ranked on a scale of 1 to 5 shown in the following evaluation criteria. The fixation temperature in a fixation experiment performed at the lowest temperature among the fixation temperatures in experiments with rank 3 was evaluated as a lowest fixable temperature. The results are shown in TABLE 2.

The lower the lowest fixable temperature is, the better the low-temperature fixability is. When the lowest fixable temperature is 120° C. or lower, the developer does not cause any practical problem and is judged as pass.

—Evaluation Criteria—

Rank 5: No exfoliation occurred.

Rank 4: Exfoliation occurred along part of the fold.

Rank 3: Exfoliation occurred in thin lines along the fold.

Rank 2: Exfoliation occurred in thick lines along the fold.

Rank 1: Exfoliation occurred to a large extent.

(2) Post-Fixing Separability:

A fixation experiment was performed using a copier "BIZHUB PRO C6550" (manufactured by Konica Minolta Inc.) including a modified fixation unit. More specifically, the surface temperature of a heating roller (fixation temperature) was set to the lowest fixable temperature+10° C., and a solid image with a top margin of 5 mm was fixed over an A4 high-quality paper sheet in a room temperature and room humidity environment (temperature: 20° C., humidity: 50% RH). The fixation experiment was repeated at different toner adhesion amounts. More specifically, the toner adhesion amount was increased from 3.5 g/cm$^2$ in steps of 0.5 g/cm$^2$.

Each of the experiments performed at different toner adhesion amounts was ranked according to the following evaluation criteria. If a plurality of ranks were assigned to a developer, the best rank was used as the evaluation result. The results are shown in TABLE 2.

—Evaluation Criteria—

A (pass): Even in fixation experiments at a toner adhesion amount of 5.0 g/cm$^2$ or more, the paper sheet did not curl and was separated from the heating roller.

B (pass): In fixation experiments at a toner adhesion amount of 3.5 g/cm$^2$ or more and less than 5.0 g/cm$^2$, the paper sheet did not curl and was separated from the heating roller.

C (pass): In fixation experiments at a toner adhesion amount of 3.5 g/cm$^2$ or more and less than 5.0 g/cm$^2$, the paper sheet was separated from the heating roller by the separation claw. Although marks by the separation claw were formed on the image, the marks were almost unnoticeable.

D (fail): In a fixation experiment at a toner adhesion amount of 3.5 g/cm$^2$, the paper sheet was separated from the heating roller by the separation claw, and marks by the separation claw were formed on the image, or the paper sheet was wound around the heating roller and could not be separated from the heating roller.

TABLE 2

| | | CRYSTALLINE | FIRST AMORPHOUS | SECOND AMORPHOUS PEs RESIN | | EVALUATION RESULTS | |
|---|---|---|---|---|---|---|---|
| | TONER NO. | PEs RESIN NO. | PEs RESIN NO. | No. | SPECIFIC DIMER ACID | LOWEST FIXABLE TEMPERATURE | POST-FIXING SEPARABILITY |
| EXAMPLE 1 | 1 | [C1] | [A1] | [B1] | FORMULA (a) | 105° C. | B |
| EXAMPLE 2 | 2 | [C2] | [A2] | [B2] | FORMULA (b) | 115° C. | B |
| EXAMPLE 3 | 3 | [C1] | [A1] | [B3] | FORMULA (c) | 110° C. | B |
| EXAMPLE 4 | 4 | [C3] | [A1] | [B4] | FORMULA (d) | 120° C. | A |
| EXAMPLE 5 | 5 | [C4] | [A1] | [B5] | FORMULA (e) | 120° C. | C |
| EXAMPLE 6 | 6 | [C1] | [A1] | [B6] | FORMULA (f) | 100° C. | B |
| EXAMPLE 7 | 7 | [C1] | [A1] | [B7] | FORMULA (g) | 105° C. | A |
| EXAMPLE 8 | 8 | [C1] | [A1] | [B8] | FORMULA (h) | 105° C. | B |
| EXAMPLE 9 | 9 | [C1] | [A1] | [B9] | FORMULA (i) | 100° C. | C |
| EXAMPLE 10 | 10 | [C1] | [A1] | [B10] | FORMULA (j) | 110° C. | B |
| EXAMPLE 11 | 11 | [C1] | [A1] | [B11] | FORMULA (k) | 120° C. | C |
| EXAMPLE 12 | 12 | [C1] | [A1] | [B12] | FORMULA (l) | 110° C. | B |
| EXAMPLE 13 | 13 | [C1] | [A1] | [B13] | FORMULA (a) | 100° C. | B |
| COMPARATIVE EXAMPLE 1 | 14 | [C1] | [A1] | — | — | 125° C. | D |
| COMPARATIVE EXAMPLE 2 | 15 | [C1] | — | [B1] | FORMULA (a) | 115° C. | D |
| COMPARATIVE EXAMPLE 3 | 16 | [C1] | [A1] | ([A2]) | — | 125° C. | D |

CRYSTALLINE PEs RESIN = CRYSTALLINE POLYESTER RESIN
AMORPHOUS PEs RESIN = AMORPHOUS POLYESTER RESIN

The invention claimed is:

1. A toner for electrostatic image development, comprising toner particles having a wax and a binder resin containing a crystalline polyester resin, a first amorphous polyester resin and a second amorphous polyester resin, wherein the crystalline polyester resin is obtained by polymerization of at least a diol component and a dicarboxylic acid component, the diol component includes an aliphatic diol having a straight carbon chain with 6 to 12 carbon atoms, the dicarboxylic acid component includes an aliphatic dicarboxylic acid having a straight carbon chain with 6 to 12 carbon atoms excluding carbon atoms in carboxyl groups, the second amorphous polyester resin includes a structural unit derived from any of monomers represented by the following general formulas (1) to (3) and a structural unit derived from terephthalic acid, a structural unit derived from a propylene oxide adduct of bisphenol A and a structural unit derived from an ethylene oxide adduct of bisphenol A, and the first amorphous polyester resin includes no structural unit derived from any of the monomers represented by the following general formulas (1) to (3):

General Formula (1)

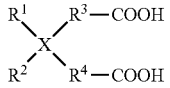

General Formula (2)

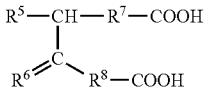

General Formula (3)

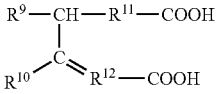

wherein, in the general formulas (1) to (3), $R^1$, $R^2$, $R^5$, $R^9$ and $R^{10}$ are each independently an alkyl group having 4 to 15 carbon atoms or an alkenyl group having 4 to 15 carbon atoms, $R^3$, $R^4$, $R^7$, $R^8$ and $R^{11}$ are each independently an alkylene group having 4 to 14 carbon atoms or an alkenylene group having 4 to 14 carbon atoms, $R^6$ is a saturated or unsaturated divalent aliphatic hydrocarbon group having 4 to 15 carbon atoms, and $R^{12}$ is a saturated or unsaturated trivalent aliphatic hydrocarbon group having 4 to 14 carbon atoms, and, in the general formula (1), X is an aromatic ring, a carbocyclic ring or a group represented by the following formula (A), Formula (A)

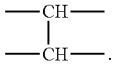

2. The toner for electrostatic image development according to claim 1, wherein the structural unit constituting the second amorphous polyester resin and derived from any of the monomers represented by the general formulas (1) to (3) is a structural unit derived from any of monomers represented by the following formulas (a) to (1), Formula (a)

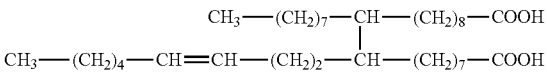

Formula (b)

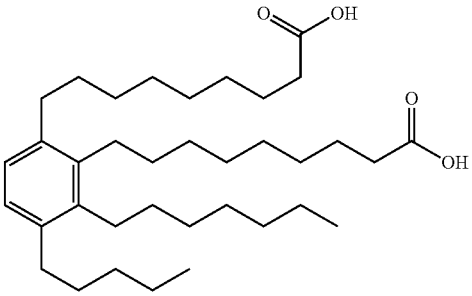

-continued

Formula (c)

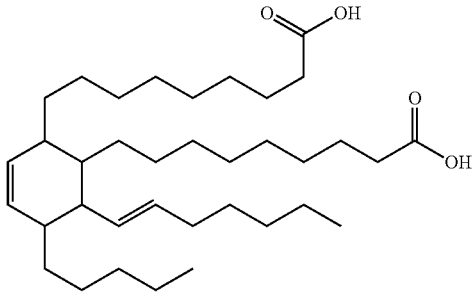

Formula (d)

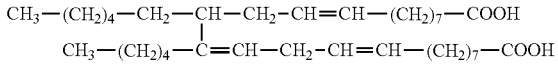

Formula (e)

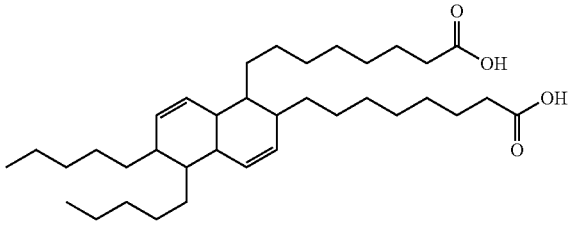

Formula (f)

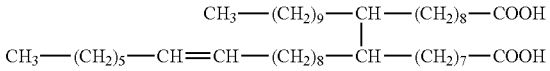

Formula (g)

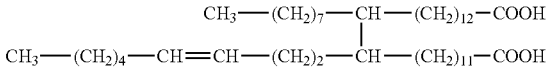

Formula (h)

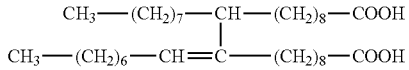

Formula (i)

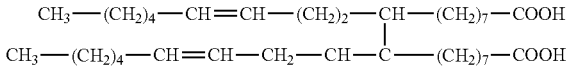

Formula (j)

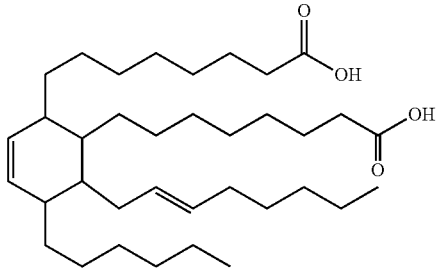

Formula (k)

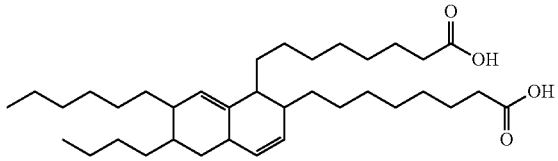

-continued

Formula (I)

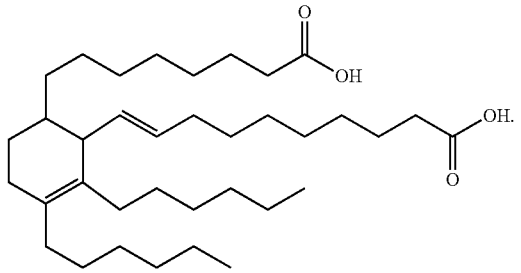

3. The toner for electrostatic image development according to claim 1, wherein the first amorphous polyester resin includes a structural unit derived from terephthalic acid, a structural unit derived from a propylene oxide adduct of bisphenol A and a structural unit derived from an ethylene oxide adduct of bisphenol A.

4. The toner for electrostatic image development according to claim 1, wherein the second amorphous polyester resin includes a structural unit derived from an alicyclic diol.

5. The toner for electrostatic image development according to claim 1, wherein the wax is a hydrocarbon wax.

6. The toner for electrostatic image development according to claim 1, wherein the mass ratio of the content of the first amorphous polyester resin to the content of the second amorphous polyester resin, i.e., (the first amorphous polyester resin:the second amorphous polyester resin), is 95:5 to 60:40.

7. The toner for electrostatic image development according to claim 1, wherein the molecular weight of the first amorphous polyester resin measured by gel permeation chromatography (GPC) is 5,000 to 100,000, in terms of the weight average molecular weight (Mw).

8. The toner for electrostatic image development according to claim 1, wherein the molecular weight of the second amorphous polyester resin measured by gel permeation chromatography (GPC) is 1,000 to 10,000, in terms of the weight average molecular weight (Mw).

9. The toner for electrostatic image development according to claim 1, wherein the glass transition point of the first amorphous polyester resin is 40 to 90° C.

10. The toner for electrostatic image development according to claim 1, wherein the glass transition point of the second amorphous polyester resin is 20 to 90° C.

11. The toner for electrostatic image development according to claim 1, wherein the melting point of the crystalline polyester resin is 40 to 90° C.

12. The toner for electrostatic image development according to claim 1, wherein the content of the crystalline polyester resin in the binder resin is 3 to 30% by mass.

13. The toner for electrostatic image development according to claim 1, wherein the content of the wax is 1 to 30 parts by mass per 100 parts by mass of the binder resin.

* * * * *